US010697178B2

(12) United States Patent
Johnson, III

(10) Patent No.: US 10,697,178 B2
(45) **Date of Patent: *Jun. 30, 2020**

(54) REINFORCING BAR POSITIONER AND METHOD

(71) Applicant: Masonry Reinforcing Corporation of America, Charlotte, NC (US)

(72) Inventor: Ralph O. Johnson, III, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/585,742

(22) Filed: Sep. 27, 2019

(65) Prior Publication Data

US 2020/0063436 A1 Feb. 27, 2020

Related U.S. Application Data

(63) Continuation of application No. 16/035,988, filed on Jul. 16, 2018, now Pat. No. 10,563,405, which is a continuation-in-part of application No. 15/993,655, filed on May 31, 2018, now Pat. No. 10,550,573.

(51) Int. Cl.
*E04C 5/18* (2006.01)
*E04C 5/16* (2006.01)

(52) U.S. Cl.
CPC ..... *E04C 5/168* (2013.01); *E04C 5/18* (2013.01)

(58) Field of Classification Search
CPC ... E04C 5/18; E04C 5/168; E04C 5/16; E04C 5/167; E04C 5/201; E04G 21/12
USPC ..... 52/604, 686, 687, 699, 712; 248/249, 248/302
See application file for complete search history.

(56) References Cited

U.S. PATENT DOCUMENTS

| | | | | |
|---|---|---|---|---|
| 1,155,411 | A | 10/1915 | Flannery | |
| 1,616,977 | A * | 2/1927 | Koivu | E04B 2/8652 52/426 |
| 1,858,836 | A * | 5/1932 | Martell | E04C 5/16 52/647 |
| 4,107,895 | A | 8/1978 | LeGrady | |
| 4,190,999 | A | 3/1980 | Hampton | |
| 4,337,605 | A | 7/1982 | Tudek | |
| 5,704,188 | A | 1/1998 | Coulis | |

(Continued)

*Primary Examiner* — Joshua J Michener
*Assistant Examiner* — James J Buckle, Jr.
(74) *Attorney, Agent, or Firm* — Shumaker, Loop & Kendrick, LLP

(57) ABSTRACT

A rebar positioner for being placed within an open core of a masonry block having an open core and an adjacent closed core separated by a web. A wire defines first and second laterally spaced-apart support elements adapted to extend over and be supported by the web of the block. End portions of the first and second support elements are adapted for extending into the enclosed core of the block. A rebar positioning segment defines at least one ring adapted for being positioned within the open core of the block and surrounding a section of vertically extending rebar positioned in the open core. The wire is bent such that the end portions of the first and second support elements are adapted for extending into the closed core at a level below an upper surface of the block and the at least one ring is adapted for extending into the open core at a level below the upper surface of the block.

5 Claims, 11 Drawing Sheets

(56) References Cited

U.S. PATENT DOCUMENTS

| | | | | |
|---|---|---|---|---|
| 6,141,937 | A | 11/2000 | Dressler | |
| 6,922,968 | B1 | 8/2005 | Behlen | |
| 7,467,777 | B2 | 12/2008 | Huber | |
| 7,765,765 | B1 | 8/2010 | Perronne | |
| 8,122,675 | B2 | 2/2012 | Johnson | |
| 8,448,404 | B2 | 5/2013 | Johnson | |
| 2005/0023432 | A1* | 2/2005 | Huber | E02D 27/01 249/34 |
| 2007/0157541 | A1* | 7/2007 | Mossbeck | E04C 5/18 52/677 |
| 2012/0227350 | A1* | 9/2012 | Wester | E04C 5/168 52/687 |
| 2017/0130457 | A1* | 5/2017 | Naujoks | E04C 5/163 |

* cited by examiner

REINFORCING BAR POSITIONER AND METHOD

CROSS REFERENCE TO RELATED APPLICATION

This application claims priority to and benefit from U.S. Non Provisional application Ser. No. 16/035,988 filed on Jul. 16, 2018 which claims priority to and benefit from U.S. Non Provisional application Ser. No. 15/993,655 filed May 31, 2018.

TECHNICAL FIELD AND BACKGROUND OF THE INVENTION

The present invention relates generally to the field of reinforcing bar ("rebar") positioners, and more particularly, to a rebar positioner intended for use with a relatively new type of concrete masonry unit block manufactured and sold under the trademark ProBlock, and a method for utilizing such rebar positioners. Whereas conventional masonry blocks have two or more closed cores separated by a web, as shown in FIGS. 3, 4 and 5, the ProBlock blocks "B" have a single closed core "CC" and an open core "OC" between two face shells "S1" and "S2" separated by a web "W". These blocks are manufactured in 8 inch and 12 inch widths, with variations to accommodate building and code requirements. Stated advantages of this design include lighter weight and the ability to position the blocks around vertically-positioned rebar extending up through a course of blocks without the need to lift the block over the top of the rebar to position it within the positioner, as is the case with closed core blocks. As used in this application, the term "open core" means that the core is defined by only three vertical walls, leaving one side of the core defined by the height of the block "open".

It is common in masonry block construction to position rebar vertically within the core of a concrete block or other masonry block unit to provide added strength and stability to the masonry structure. In general, rebar will be used in selected cores, for example 24" on center that are filled with grout to anchor the rebar in its reinforcing position. Generally, it is desirable to have the rebar positioned at or proximate the center of the block core to maximize the stabilizing effect of the rebar. As such, a positioner is often used to maintain the rebar at the desired position within the block core while grout, concrete or other hardening fill material is poured into the block core.

Prior art rebar positioners typically include brackets with a closed or nearly closed ring-like area within which the rebar is positioned, and opposing members that extend perpendicularly over the block core onto the top surface of the block. Many of these prior art rebar positioners are constructed such that they lie entirely in one plane, and as such they extend over the top of the core block. Therefore, positioners must rely on the next masonry block being positioned on top of it to maintain its proper position, and the positioners are easily disturbed by movement of the overlying block. The perpendicular arrangement of the positioners contributes to their susceptibility to falling out of position. If the rebars are not maintained in their proper position, the strength and stability of the masonry structure is compromised.

To overcome the disadvantages of the prior art rebar positioner designs, U.S. Pat. No. 8,122,675 discloses and claims a continuous length of wire bent to provide a geometry that spans the corresponding diagonal length of the core of the block, seats only end portions of the positioner in the plane of the surface of the block, positions the rebar maintaining portions down within the core, and includes a telltale for indicating proper installation of the positioner within the core to ensure alignment of the rebar along the longitudinal axis of the block.

The development of the ProBlock style of masonry block with the open core suggests a different approach since the open cores do not support the type of positioner disclosed in the U.S. Pat. No. 8,122,675.

BRIEF SUMMARY OF THE INVENTION

Therefore, it is an object of the invention to provide a rebar positioner for properly positioning rebar within an open core of a masonry block.

It is another object of the invention to provide a rebar positioner that uses the single web of an open core masonry block to prevent shifting of the positioner upon installation of an overlying block.

It is another object of the invention to provide a rebar positioner that sits within the height of the block but is supported by the web of the block.

These and other objects of the invention are achieved in the embodiments of the invention described in this application. In one embodiment, a rebar positioner is provided for being placed within an open core of a masonry block having an open core and an adjacent closed core separated by a web. The rebar positioner includes a wire defining first and second laterally spaced-apart support elements adapted to extend over and be supported by the web of the block. Respective end portions of the first and second support elements are adapted for extending into the enclosed core of the block and a rebar positioning segment defines at least one ring adapted for being positioned within the open core of the block and surrounding a section of vertically extending rebar positioned in the open core. The wire is bent such that the end portions of the first and second support elements are adapted for extending into the closed core at a level below an upper surface of the block and the at least one ring is adapted for extending into the open core at a level below the upper surface of the block.

In accordance with another aspect of the invention, the first and second support elements diverge away from the at least one ring.

In accordance with another aspect of the invention, the first and second rings comprise first and second "S"-shaped rings.

In accordance with another aspect of the invention, the rebar positioner is formed of a single continuous length of wire.

In accordance with another aspect of the invention, the first and second support elements are defined by respective spaced-apart right angle bends.

In accordance with another aspect of the invention, the first and second rings are aligned with a longitudinal axis of the rebar positioning segment.

In accordance with another aspect of the invention, the total length of the rebar positioner from a distal edge of the at least one ring to the first and second support elements is at least 6 inches.

In accordance with another aspect of the invention, the support elements diverge away from the at least one ring at an angle of at least about 30 degrees.

In accordance with another aspect of the invention, the support elements diverge away from the at least one ring at an angle of at least about 45 degrees.

In accordance with another aspect of the invention, a rebar positioner is provided for being placed within an open core of a masonry block having an open core and an adjacent closed core separated by a web, and includes a single, continuous wire bent at two right angle bends to define first and second laterally spaced-apart and diverging support elements adapted to extend over and be supported by the web of the block. Respective end portions of the first and second support elements are adapted for extending into the enclosed core of the block. A rebar positioning segment defines first and second sinuous "S"-shaped rings adapted for being positioned within the open core of the block and surrounding a section of vertically extending rebar positioned in the open core. The wire is bent such that the end portions of the first and second support elements extend into the closed core at a level below an upper surface of the block and the first and second "S"-shaped rings are adapted for extending into the open core at a level below the upper surface of the block.

A method of positioning a vertically-extending length of rebar within an open core of a masonry block having an open core and an adjacent closed core separated by a web according to an aspect of the invention is disclosed. The method includes the steps of providing a wire bent to define first and second laterally spaced-apart support elements adapted to extend over and be supported by the web of the block, respective end portions of the first and second support elements adapted for extending into the enclosed core of the block, a rebar positioning segment defining at least one sinuous "S"-shaped ring. The wire is bent such that the end portions of the first and second support elements are adapted for extending into the closed core at a level below an upper surface of the block and the at least one sinuous "S"-shaped ring is adapted for extending into the open core at a level below the upper surface of the block. A block having an open core and an adjacent closed core separated by a web is placed onto a course of blocks. The rebar positioner is placed into the open core of the block with the first and second laterally spaced-apart support elements extending over and being supported by the web of the block with respective end portions of the first and second support elements extending into the enclosed core of the block and the first and second rings positioned in the open core of the block. The vertically-extending rebar is placed within the at least one ring, and the open core of the block is filled with grout.

In accordance with another aspect of the invention the method includes the step of forming the rebar positioner from a single continuous length of wire.

In accordance with another aspect of the invention the method includes the step of providing first and second laterally spaced-apart support elements defining a space less than the length of the web sufficient to enable insulation material to be placed between the first and second laterally spaced-apart support elements and an open core of the block.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
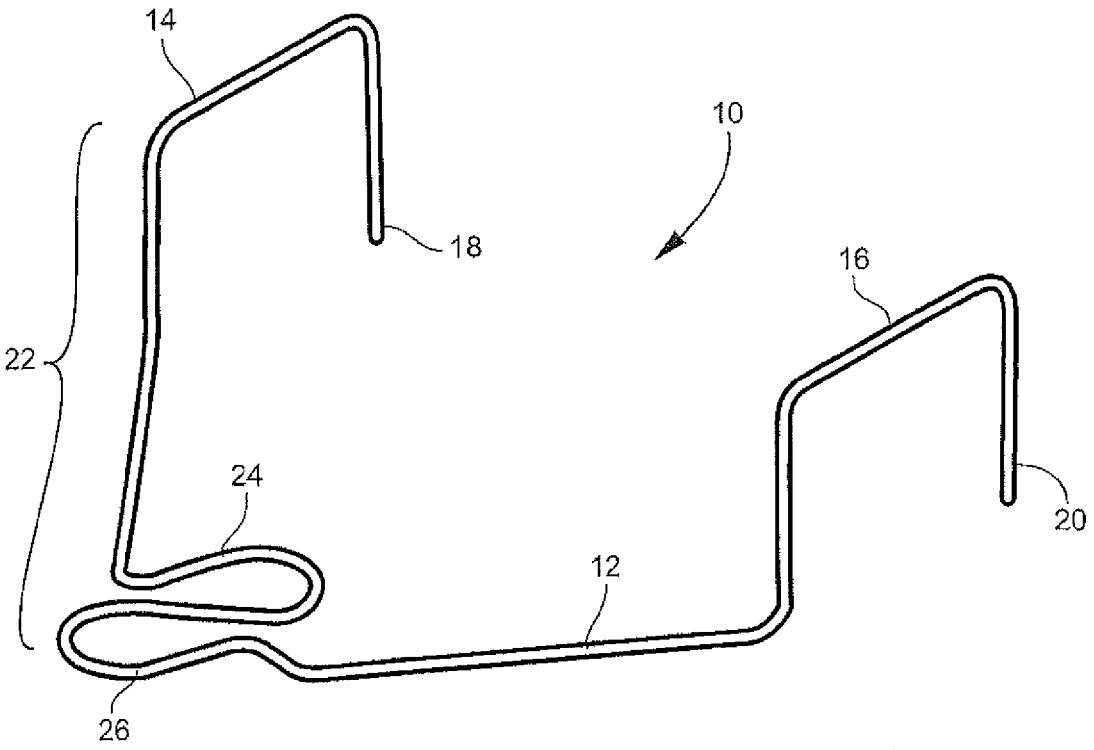
FIG. 1 is a perspective view of a rebar positioner according to a preferred embodiment of the invention.
Figure 3:
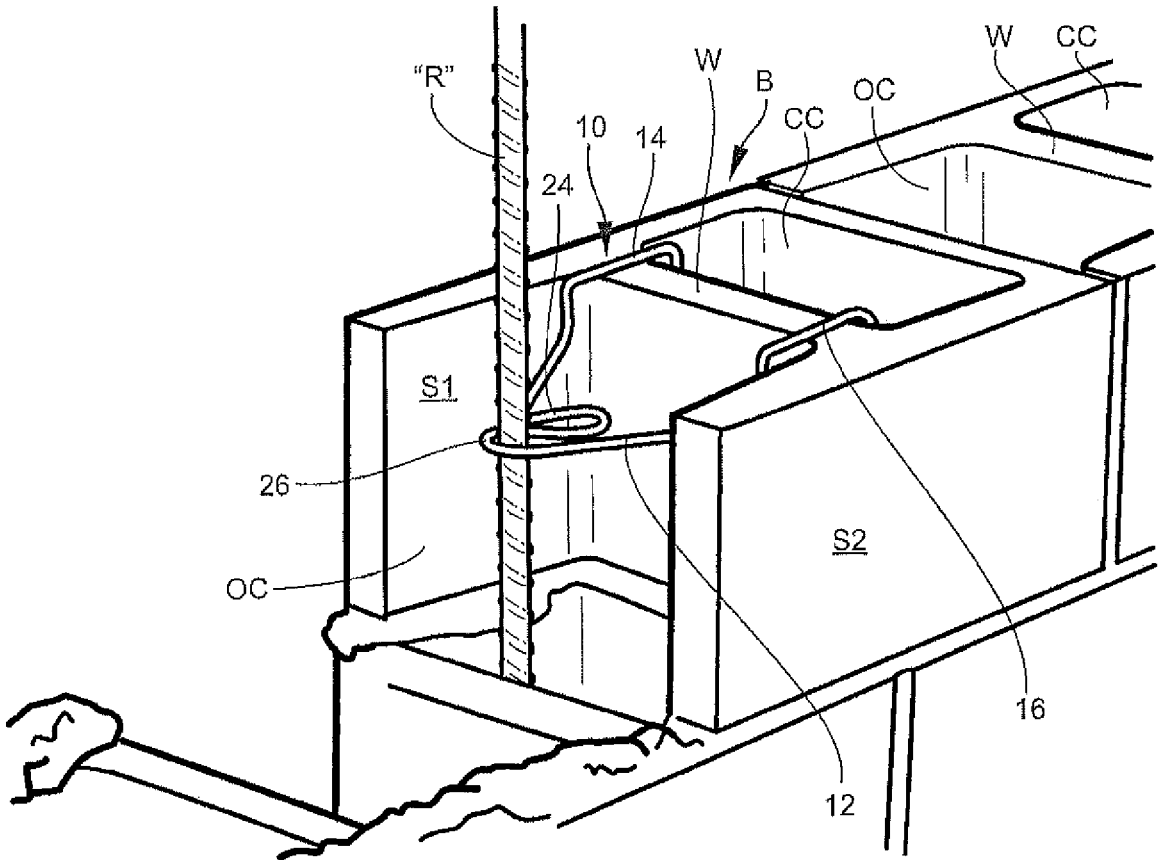
FIG. 3 is an environmental perspective view of a rebar positioner according to an embodiment of the invention in place in the open core of a masonry block.
Figure 4:
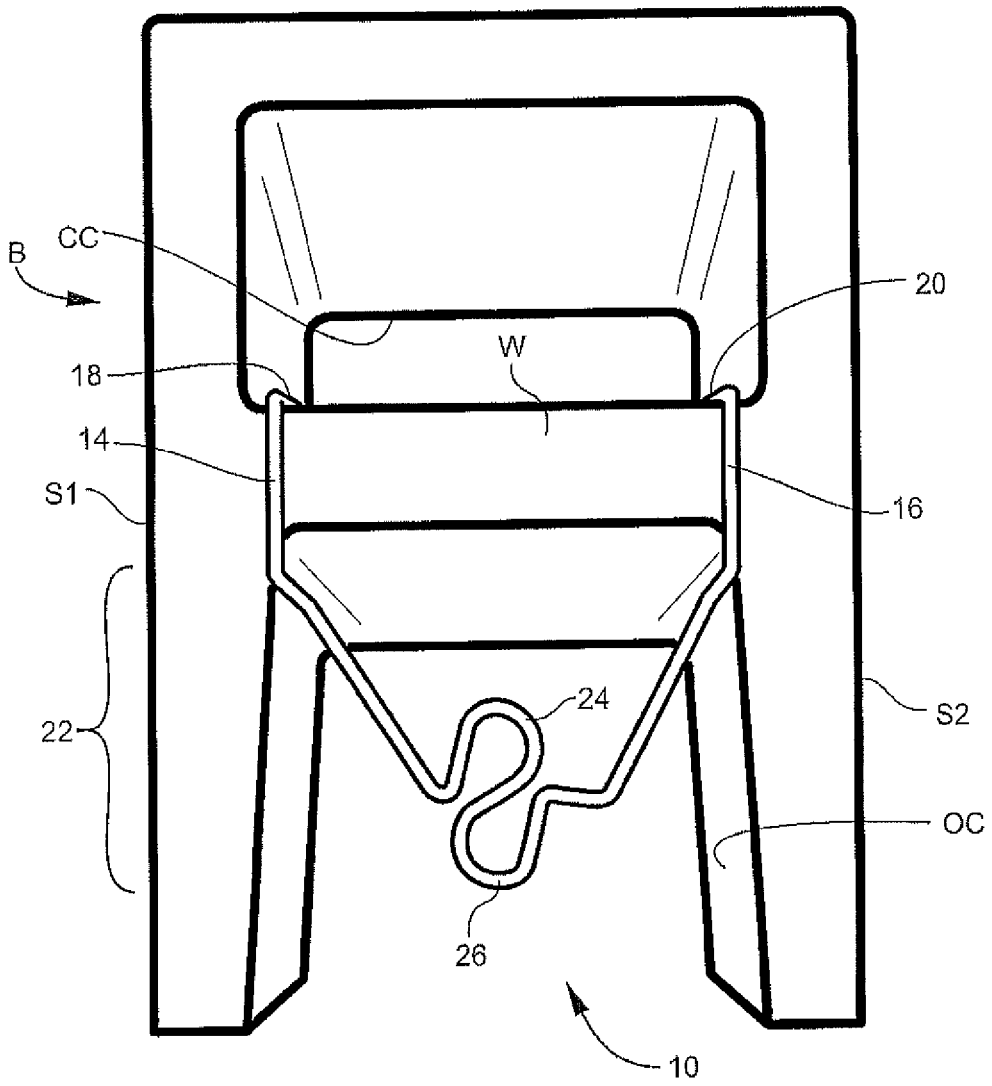
FIG. 4 is a top plan view of a rebar positioner positioned in an open core of a masonry block.

Referring now to the drawings, a rebar positioner according to a preferred embodiment of the invention is illustrated in FIGS. 1, 3 and 4, and is shown generally at reference numeral 10. The rebar positioner 10 is constructed and configured to be used with a masonry block "B" of the type having an open core "OC" and a closed core "CC" separated by a web "W". The block 10 includes face shells "S1" and "S2". The rebar positioner 10 is preferably formed of a single, continuous wire 12 bent to define first and second laterally spaced-apart support elements 14, 16 that when in proper position are supported by the web "W" of the block "B". End portions 18, 20 of the support elements 14, 16 are bent in a manner so that they can be extended downwardly into the closed core "CC" of the block "B". A rebar positioning segment 22 is defined by sinuous "S"-shaped 1-inch diameter rings 24, 26 for being positioned downwardly within the open core of the block and for surrounding and positioning in a central location a section of vertically extending rebar "R". Use of the term "ring" does not imply a closed structure, as with a finger ring, but only a structure that is sufficiently curved on itself to retain the rebar "R" within the area defined by the curved structure of the rings 24, 26. The rings 24, 26 may be formed as shown in the drawings, or may comprise separate rings or loops attached to the rebar positioner 10 by welding, brazing or otherwise.

As best shown in FIG. 3, the support elements 14, 16 serve as hooks to support the positioner 10 on the web "W" of the block "B". The wire 12 is bent at a substantial right angle to position the end portions 18, 20 of the positioner 10 in the closed core "CC" of the block "B" and at a level below the upper surface of the block "B", and the rebar positioning segment 22 likewise in the open core "OC" of the block "B" at a level below the upper surface of the block "B". After the rebar "R" is positioned in one of the rings 24 or 26, another block is placed adjacent the open core "OC" shown in FIG. 3 to enclose the core "OC", and the core "OC" is thereafter filled with grout.

The two rings 24, 26 are necessary because lapping of the rebar "R" occurs at the positioner 10 so a ring is necessary for two lengths of rebar "R" at the lapping location. The laps can be 24 inches or more depending on the diameter of the rebar "R".

The rebar positioner 10 is dimensioned for a 12 inch block and formed of 9 ga. (0.148") wire that has a total length from the tip of the rings 24, 26 to the end portions 18, 20 of 6⅞ inches. The angle of spread of the rebar positioning segment 22 is 45 degrees. This distance between the support elements 14, 16 is 7½ inches. The width of web of the 12 inch block of FIGS. 1, 3 and 4 is 2⅛ inch, and width of the support elements 14, 16 is therefore slightly greater in order to fit over the web "W".

Figure 2:
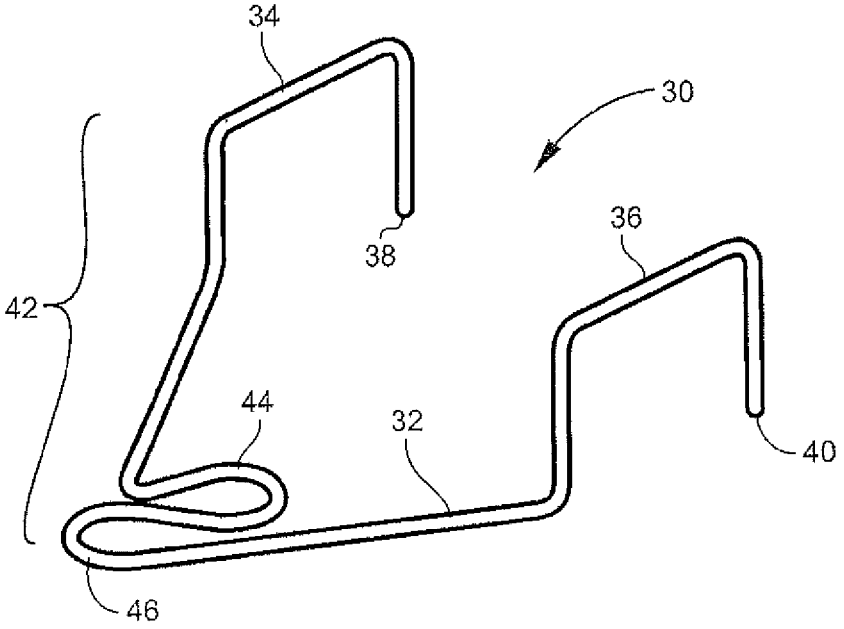
FIG. 2 is a perspective view of a rebar positioner according to another preferred embodiment of the invention.
Figure 5:
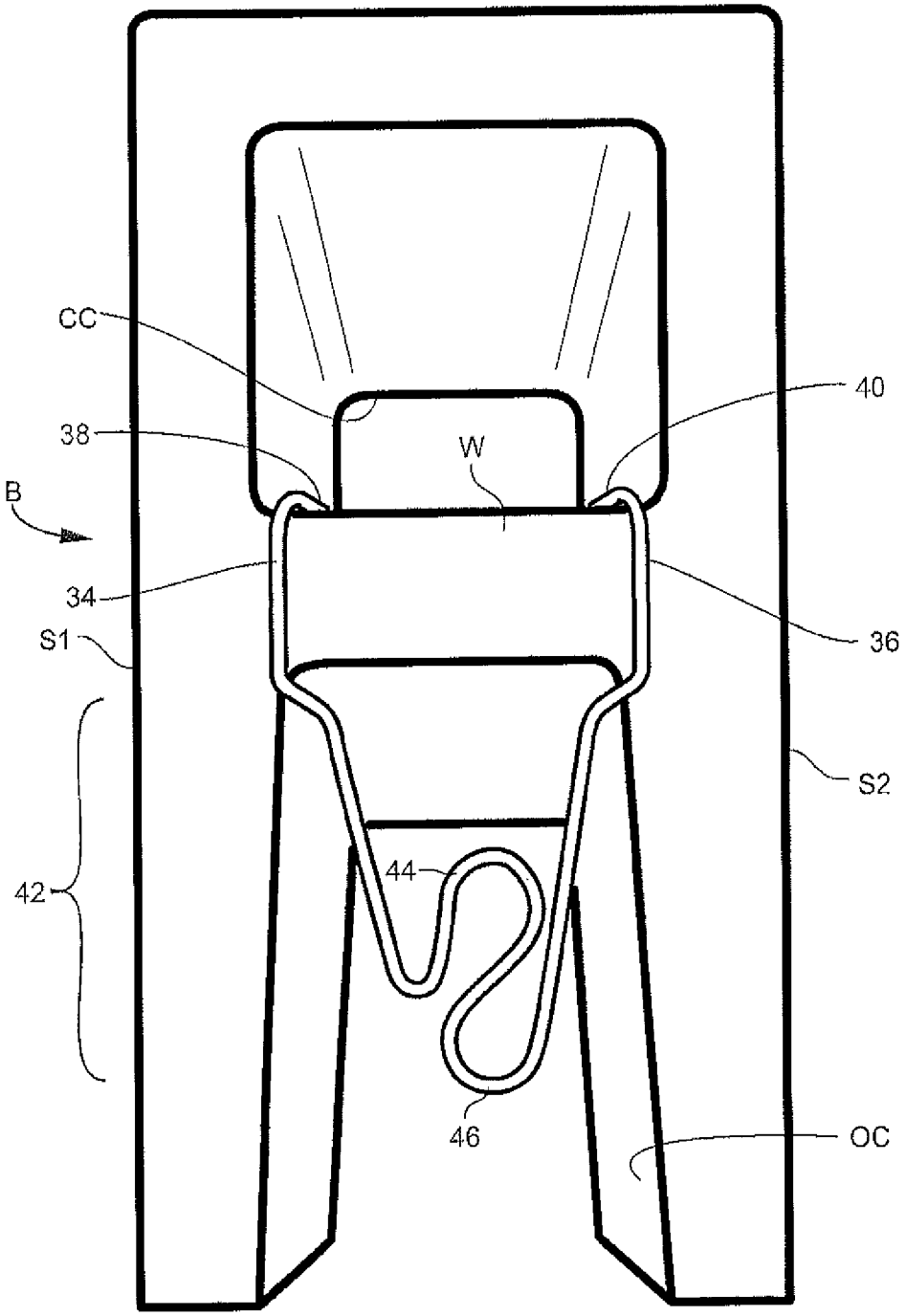
FIG. 5 is a top plan view of a rebar positioner positioned in an open core of a masonry block according to another embodiment of the invention.

Referring now to FIGS. 2 and 5, a rebar positioner according to another preferred embodiment of the invention is shown generally at reference numeral 30. The rebar positioner 30 is formed of a single, continuous wire 32 bent to define first and second laterally spaced-apart support elements 34, 36 to be supported by the web of a block with respective end portions 38, 40 of the support elements 34, 36 extended downwardly into a closed core of the block. A rebar positioning segment 42 defines sinuous "S"-shaped 1-inch diameter rings 44, 46 for being positioned within the open core of the block and surrounding a section of vertically extending rebar.

As best shown in FIG. 5, the support elements 34, 36 serve as hooks to support the positioner 30 on the web of the block. The wire 32 is bent at a substantial right angle to position the end portions 38, 40 of the positioner 10 in the closed core of the block and at a level below the upper surface of the block, and the rebar positioning segment 42 likewise in the open core of the block at a level below the upper surface of the block. After the rebar is positioned in one of the rings 44 or 46, another block, not shown, is placed adjacent the open core "OC" shown in FIG. 5 to enclose the core, and the core is filled with grout.

As with the rebar positioner 10, the two rings 44, 46 of positioner 30 are necessary because lapping of the rebar "R" occurs at the positioner 30 so a ring is necessary for two lengths of rebar "R" at the lapping location.

The rebar positioner 30 is dimensioned for an 8 inch block and formed of 9 ga. (0.148") wire that has a total length from the tip of the rings 44, 46 to the end portions 38, 40 of 6½ inches. The angle of spread of the rebar positioning segment 42 is 30 degrees. This distance between the support elements 34, 36 is 3¾ inches. The width of web of the 8 inch block of FIGS. 2 and 5 is 1/15/16 inches, and width of the support elements 34, 36 is therefore slightly greater in order to fit over the web.

Figure 6:
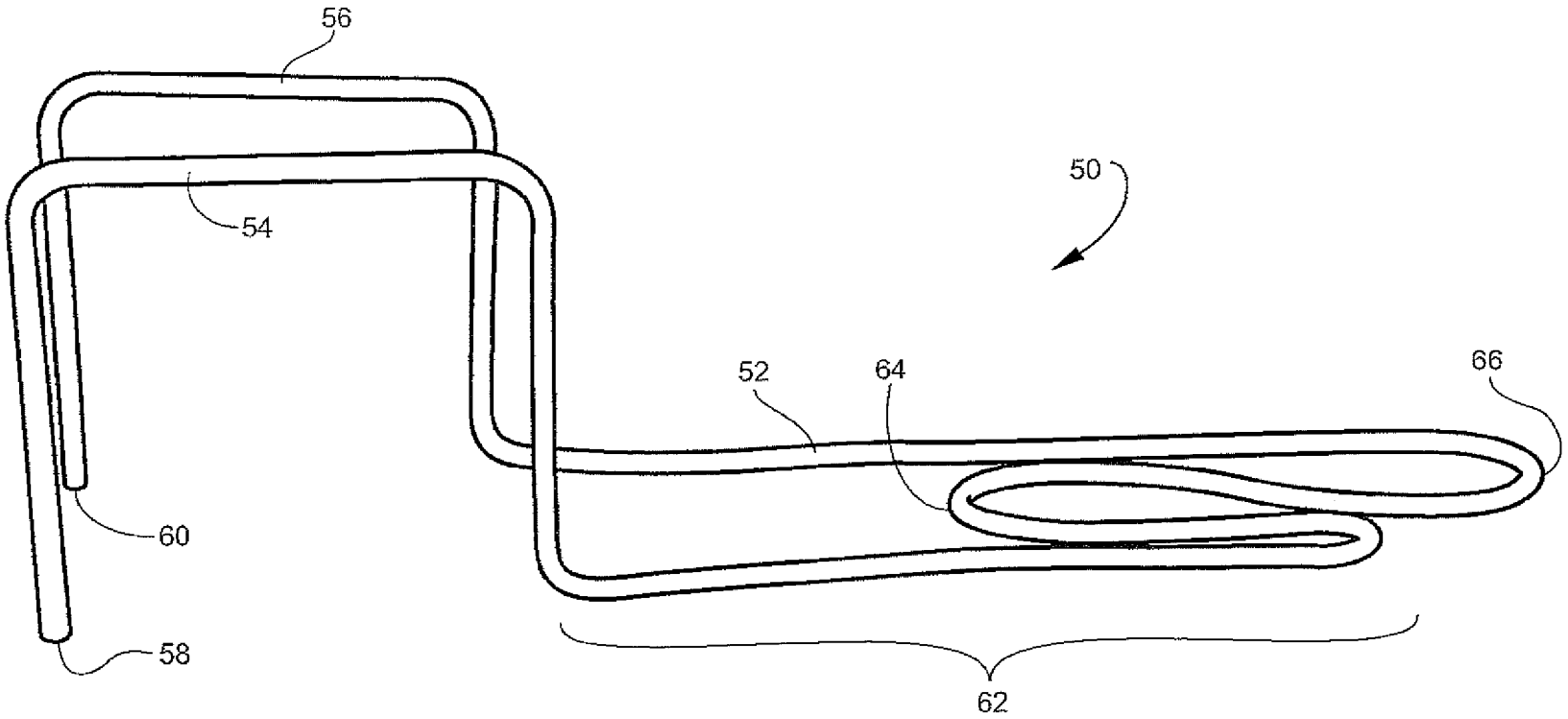
FIG. 6 is a perspective view of a rebar positioner according to an alternative preferred embodiment of the invention.
Figure 7:
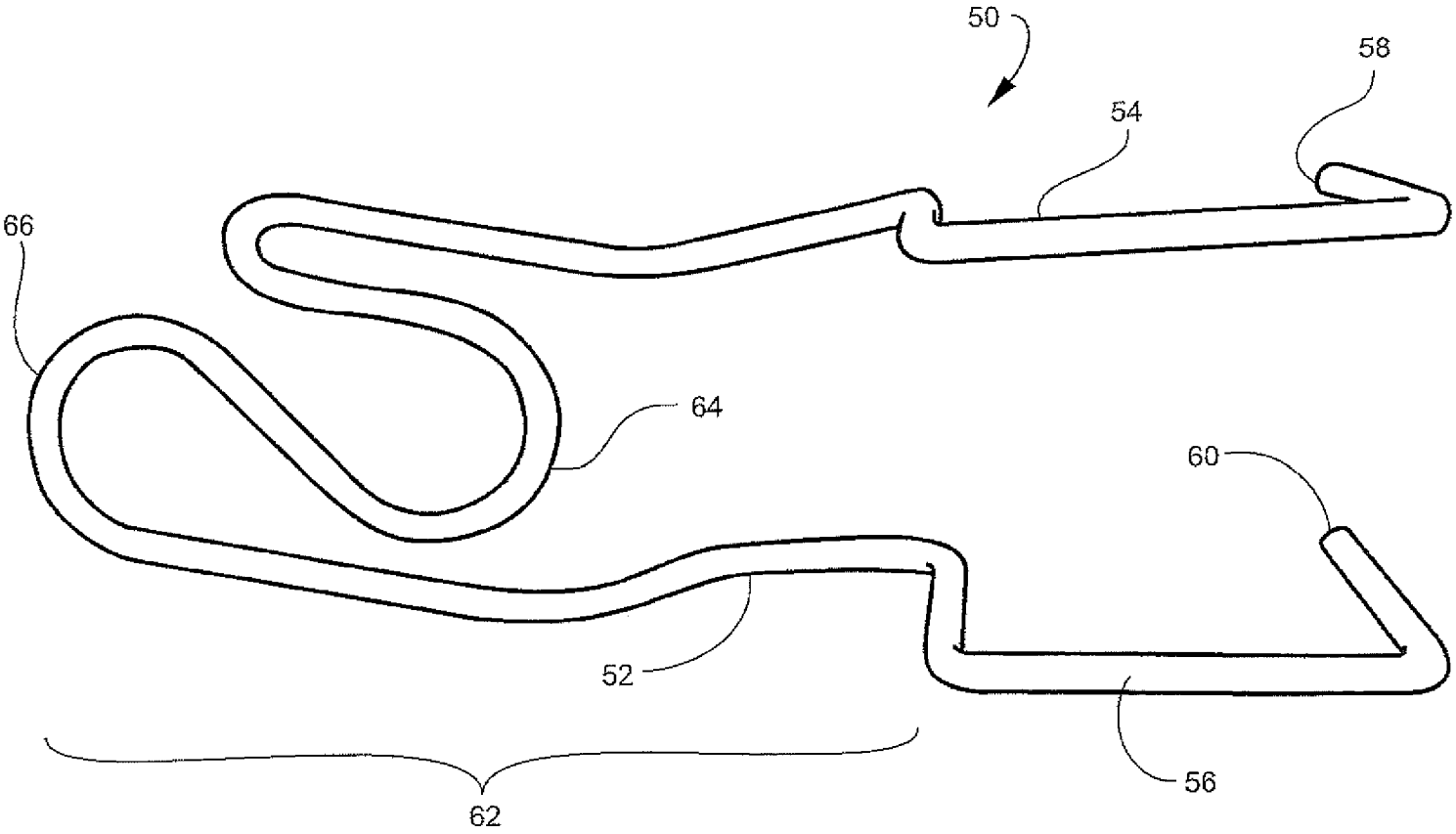
FIG. 7 is a top plan view of the rebar positioner shown in FIG. 6.

Referring now to FIGS. 6 and 7, a rebar positioner 50 for use when insulation is to be placed within the block "B" is preferably formed of a single, continuous wire 52 bent to define first and second laterally spaced-apart support elements 54, 56 that when in proper position are supported by the web "W" of the block "B". End portions 58, 60 of the support elements 54, 56 are bent in a manner so that they can be extended downwardly into the closed core "CC" of the block "B". A rebar positioning segment 62 is defined by sinuous "S"-shaped 1-inch diameter rings 64, 66 for being positioned downwardly within the open core of the block and for surrounding and positioning in a central location a section of vertically extending rebar. Use of the term "ring" does not imply a closed structure, as with a finger ring, but only a structure that is sufficiently curved on itself to retain the rebar "R" within the area defined by the curved structure of the rings 64, 66. The rings 64, 66 may be formed as shown in the drawings, or may comprise separate rings or loops attached to the rebar positioner 50 by welding, brazing or otherwise.

Figure 8:
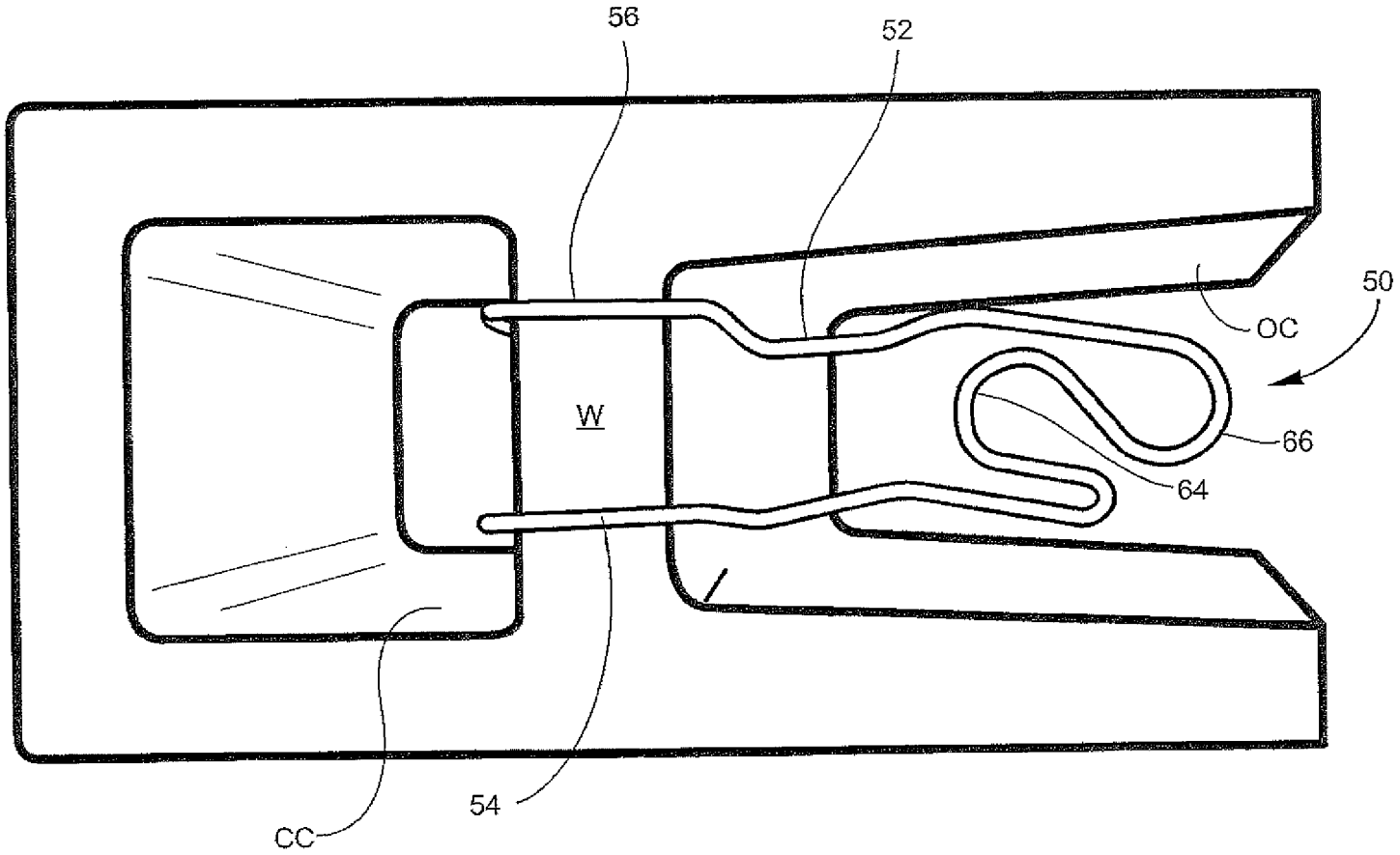
FIG. 8 is a top plan environmental view of the rebar positioner shown in FIG. 6 in place in an open core of a masonry block.

As best shown in FIG. 8, the support elements 54, 56 serve as hooks to support the positioner 50 on the web "W" of the block "B". The wire 12 is bent at a substantial right angle to position the end portions 18, 20 of the positioner 10 in the closed core "CC" of the block "B" and at a level below the upper surface of the block "B", and the rebar positioning segment 62 likewise in the open core "OC" of the block "B" at a level below the upper surface of the block "B". After the rebar "R" is positioned, as illustrated in FIG. 3, in one of the rings 64 or 66, another block "B" is placed adjacent the open core "OC" shown in FIG. 3 to enclose the core "OC", and the core "OC" is thereafter filled with grout.

The two rings 64, 66 are necessary because lapping of the rebar "R" occurs at the rebar positioner 50 so a ring is necessary for two lengths of rebar "R" at the lapping location. The laps can be 24 inches or more depending on the diameter of the rebar "R".

Figure 9:
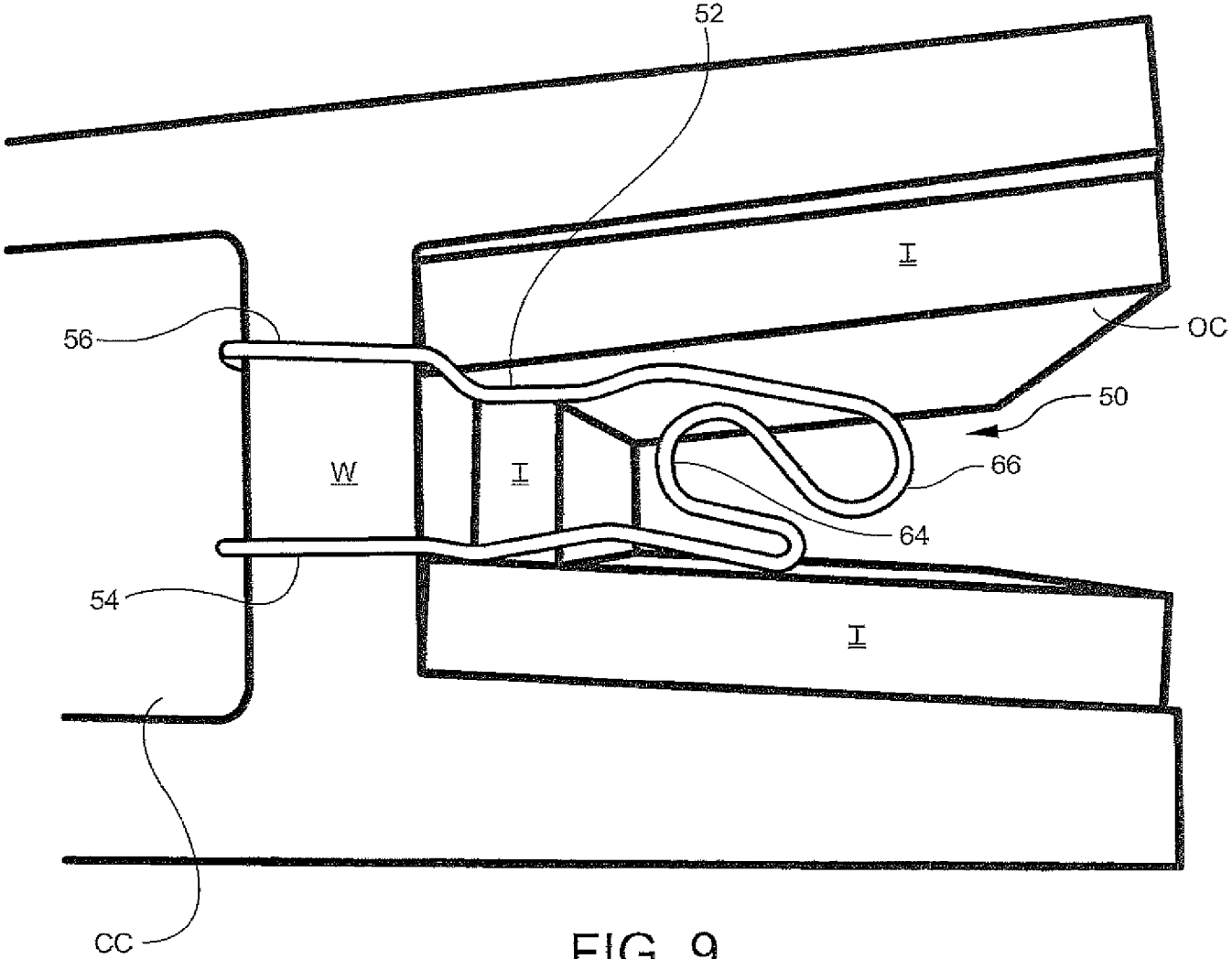
FIG. 9 is a top plan environmental view of the rebar positioner shown in FIG. 6 in place in an open core of a masonry block, and including insulation material between the rebar positioner and the walls of the block.

As shown in FIG. 8, the width of the support elements 54, 56 is about half of the length of the web "W", and likewise a substantial amount of space is left between the rebar positioning segment 62 and the adjacent walls of the block "B". Accordingly, as is shown in FIG. 9, insulation boards "I" can be fitted into the block "B" between the rebar positioning segment 62 and the walls of the block "B" and also between the support elements 54, 56. The insulation boards "I" also assist in centering the rebar positioner "50" in the open core "OC" of the block "B".

The rebar positioner 50 is dimensioned for a 12 inch block and formed of 9 ga. (0.148") wire that has a total length from the tip of the rings 64, 66 to the end portions 58, 60 of 6⅞ inches. The angle of spread of the rebar positioning segment 62 is negligible. The distance between the support elements 54, 56 is 2 inches. The width of web of the 12 inch block of FIGS. 1, 3, 4, 5, 8 and 9 is 2⅛ inch, and width of the support elements 54, 66 is therefore slightly greater in order to fit over the web "W".

According to the method of the invention, in each of the rebar positioner embodiments 10, 30 and 50, the on-center reinforcement spacing is first determined. A 24-inch on-center reinforcement utilizing an 8-inch ProBlock masonry block is such an example. ProBlock masonry blocks can be placed in a course open end to open end, open end to closed end, or closed end to closed end. Rebar is installed as required by building code, extending vertically upward. An open end to closed end orientation is preferred to minimize grout use with the rebar positioned in the open core. For an 24-inch on-center 8-inch block wall, a rebar positioner 30 such as shown in FIGS. 3 and 5 is placed onto the block "B" with the first and second support elements 34, 36 extending across and resting on the web "W" of the block "B" with the end portions 38, 40 extending over the rebar "R" with the rebar "R" in one of the rings 44 or 46. The rebar positioning segment 42 is therefore positioned within the open core "OC" of the block "B" and extends down into the "OC". The position of the rings 44, 46 automatically centers the rebar "R" that extends vertically upwardly into the open core "OC" of the block "B" from either a previous course or foundation. See FIG. 3. Then, along the course of blocks two cores are skipped, for example two closed cores "CC". Then another rebar positioner 30 is positioned in an open core "OC" and onto the rebar as described above. The rebar positioner 50 of FIGS. 6-9 is also positioned as described above.

Figure 10:
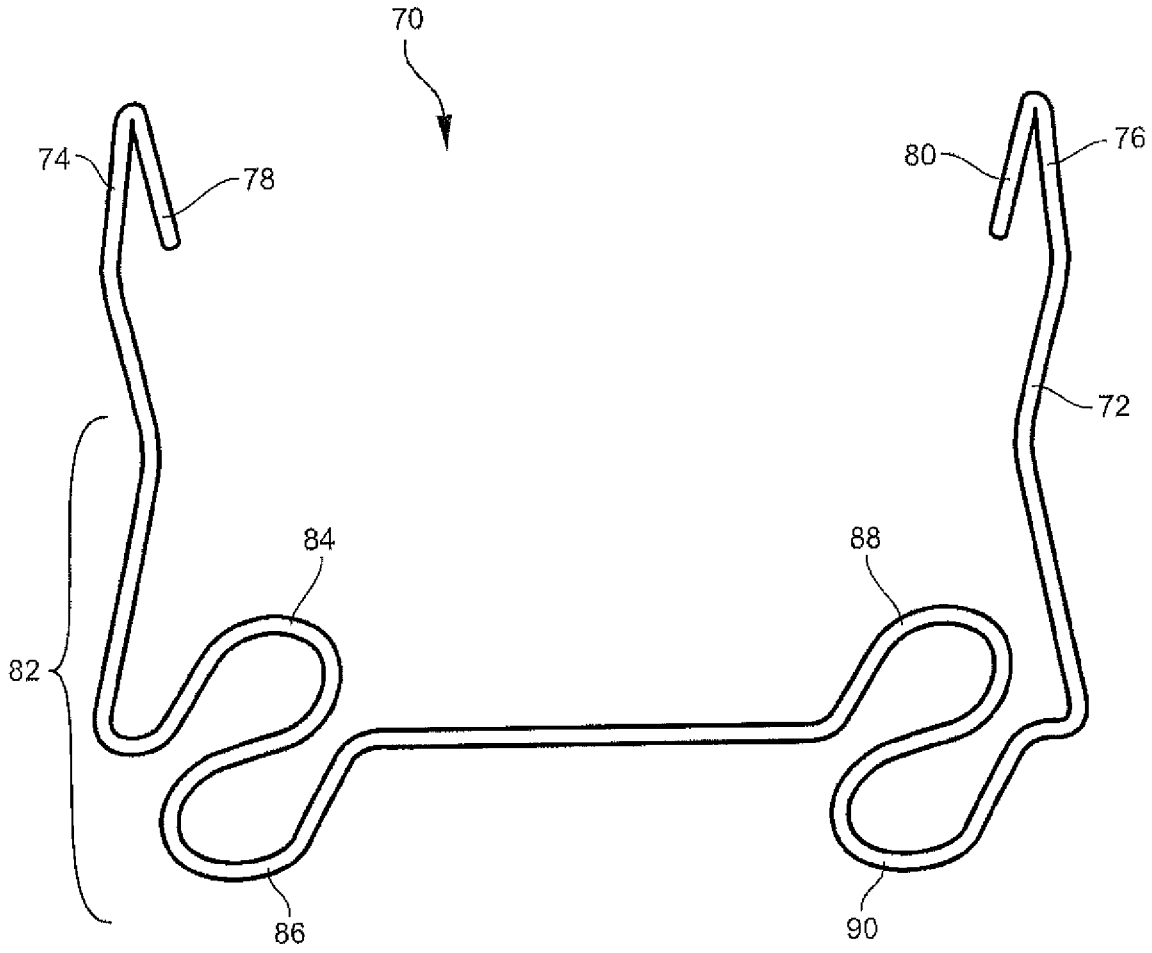
FIG. 10 is a perspective view of a rebar positioner according to an alternative preferred embodiment of the invention.
Figure 11:
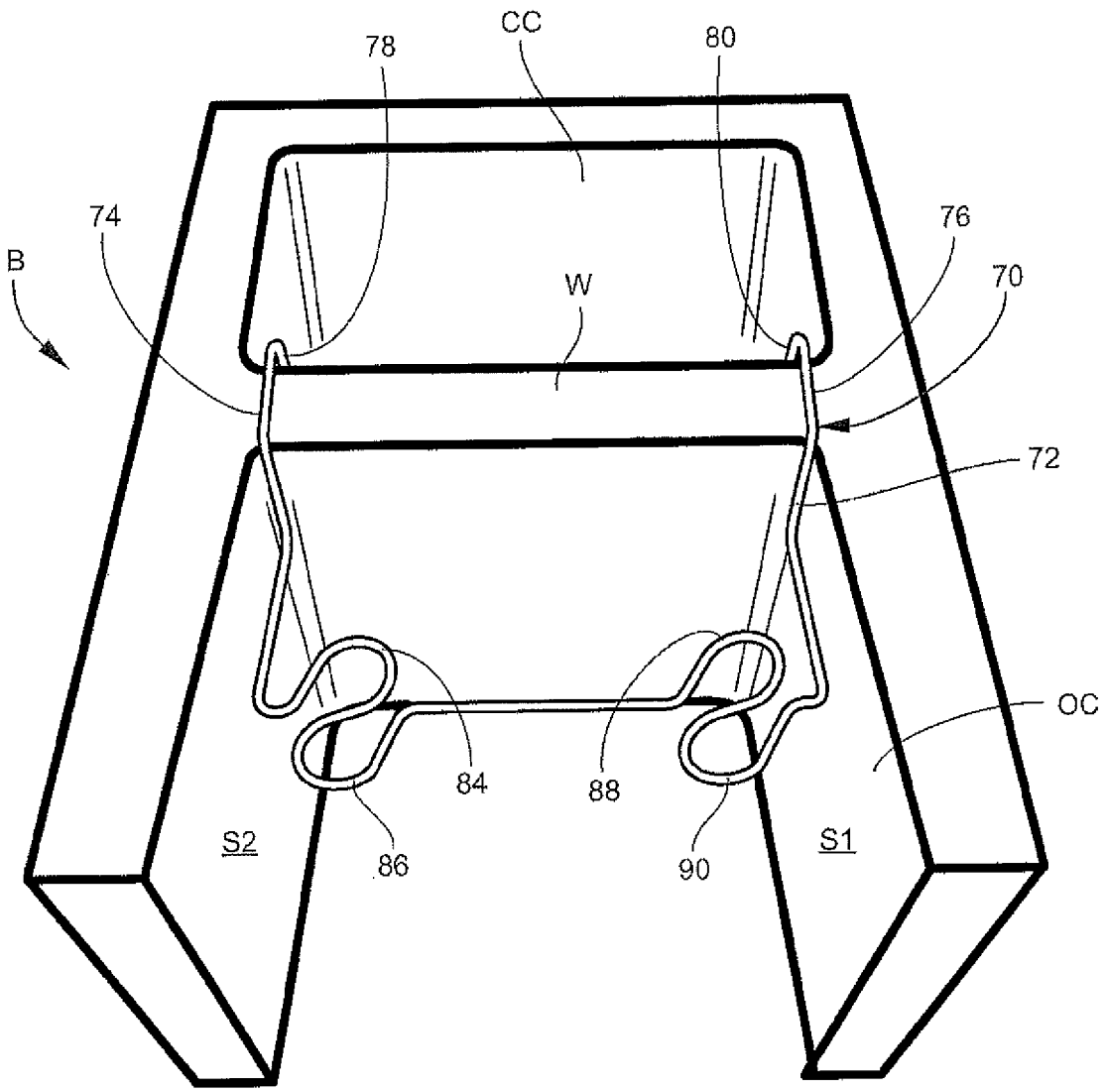
FIG. 11 is an environmental perspective view of a rebar positioner according to an alternative embodiment of the invention in place in the open core of a masonry block.
Figure 12:
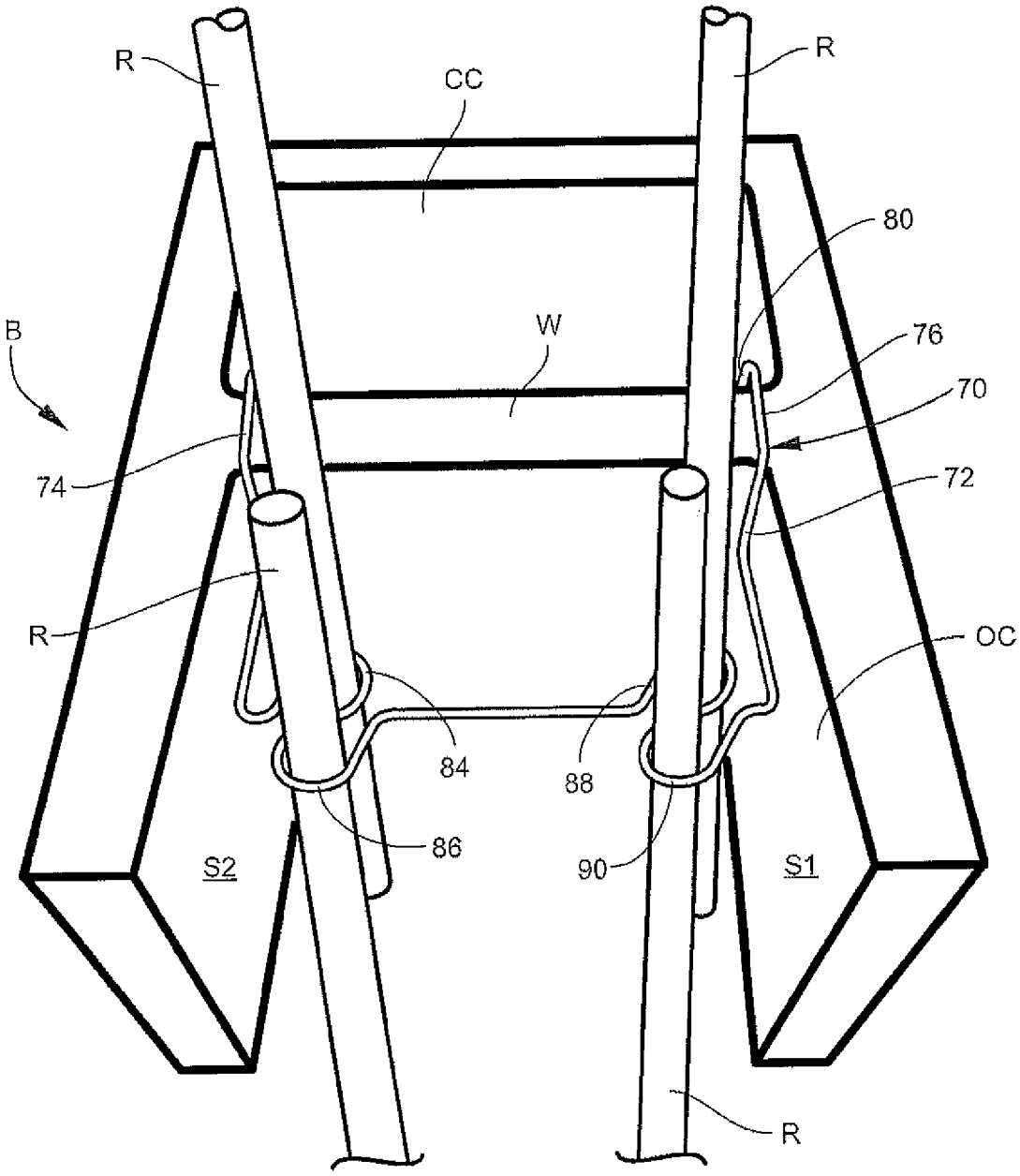
FIG. 12 is an environmental perspective view similar to FIG. 11, showing two pairs of overlapped lengths of rebar positioned in respective adjacent rings of the rebar positioner.

Referring now to FIGS. 10, 11 and 12, a rebar positioner 70 is preferably formed of a single, continuous wire 72 bent to define first and second laterally spaced-apart support elements 74, 76 that when in proper position are supported by the web "W" of the block "B". End portions 78, 80 of the support elements 74, 76 are bent in a manner so that they can be extended downwardly into the closed core "CC" of the block "B", A rebar positioning segment 82 is defined by sinuous "S shaped 1-inch diameter rings 84, 86 and 88, 90 formed to be in laterally spaced-apart relation when positioned downwardly within the open core "OC" of the block "B". Note that the first and second rings 84, 86 share a common ring section and the third and fourth rings 88, 90 share a common ring section.

The rings 84, 86 and 88, 90 surround and position in a central location sections of vertically extending rebar "R", As shown in FIG. 12, the positioner 70 permits two sections of rebar "R" to be positioned within the open core "OC". Where overlapping of the rebar "R" is necessary, they can be properly overlapped and secured together by wire or ties, as required by building codes. The rings 84, 86 and 88, 90 are located such that the rebar "R" is positioned 1-inch from the interior wall of the face shells 81 and S2, respectively.

A rebar positioner according to three illustrative embodiments is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A rebar positioner and masonry block combination, comprising:

(a) an array of joined masonry blocks, each masonry block having a pair of spaced-apart longitudinally-extending walls defining an open core and an adjacent closed core separated by a single web extending transversely between the pair of spaced-apart longitudinally-extending walls;

(b) a wire bent to define first and second laterally spaced-apart support elements and extending over and be supported by the web of each masonry block;

(c) respective end portions of the first and second support elements extending into the enclosed core of each masonry block;

(d) a rebar positioning segment defining at least one sinuous "S"-shaped ring;

(e) the wire being bent such that the end portions of the first and second support elements extend into the closed core at a level below an upper surface of the masonry block and the at least one sinuous "S"-shaped ring extends into the open core at a level below the upper surface of each masonry block;

(f) the rebar positioner positioned into the open core of each masonry block with the first and second laterally spaced-apart support elements extending over and being supported by the web of each masonry block with respective end portions of the first and second support elements extending into the enclosed core of each masonry block and the at least one sinuous "S"-shaped ring positioned in the open core of each masonry block;

(g) the vertically-extending rebar positioned within the at least one sinuous "S"-shaped ring; and (h) the open core of each masonry block filled with grout.

2. A rebar positioner and masonry block combination according to claim 1, wherein: the rebar is formed from a single continuous length of wire.

3. A method according to claim 1, wherein the first rebar positioning segment defines the at least one sinuous "S"-shaped rings adapted for being positioned within the open core of each masonry block and surrounding a section of vertically extending rebar positioned in the open core.

4. A rebar positioner and masonry block combination according to claim 1, wherein the at least one sinuous "S"-shaped rings have an open segment.

5. A method according to claim 1, wherein first and second laterally spaced-apart support elements define a space less than the length of the web sufficient to enable insulation material to be placed between the first and second laterally spaced-apart support elements and an open core of each masonry block.

* * * * *